US005647620A

United States Patent [19]

Kuenzel

[11] Patent Number: 5,647,620

[45] Date of Patent: Jul. 15, 1997

[54] CABLE LOCK AND SEAL DEVICE INCORPORATING SELF LOCKING FEATURE

[76] Inventor: Rainer Kuenzel, 2 Gessner Rd., Houston, Tex. 77024

[21] Appl. No.: 590,188

[22] Filed: Jan. 23, 1996

Related U.S. Application Data

[63] Continuation-in-part of Ser. No. 362,843, Dec. 22, 1994, abandoned.

[51] Int. Cl.[6] ..... B65D 27/30

[52] U.S. Cl. ..... 292/317; 292/307 R; 292/323

[58] Field of Search ..... 292/320, 307 R, 292/323, 315, 321, 325, 326, 307 A, 307 B

[56] References Cited

U.S. PATENT DOCUMENTS

| | | | |
|---|---|---|---|
| 3,770,307 | 11/1973 | Van Gompel | 292/307 R |
| 4,049,303 | 9/1977 | Irwin et al. | 292/307 R |
| 4,342,477 | 8/1982 | McClure | 292/307 R |
| 4,747,631 | 5/1988 | Loynes et al. | 292/307 R |
| 5,092,641 | 3/1992 | Penick, Jr. | 292/307 R |
| 5,222,776 | 6/1993 | Georgopoulos et al. | 292/323 |
| 5,352,003 | 10/1994 | Bystry | 292/323 |

FOREIGN PATENT DOCUMENTS

0417022 A1 3/1991 European Pat. Off. .

*Primary Examiner*—Rodney M. Lindsey
*Assistant Examiner*—Monica E. Millner

[57] ABSTRACT

A cable lock device is set forth. In one embodiment, a soft metal housing is constructed having an internal cavity for locking on the dead end of the cable. The cable is extended from the housing in a bight and the free end of the cable is inserted through a pair of aligned openings in said housing. The free end of the cable is immediately adjacent to a locking surface and is forced against that surface by a spring loaded rotatable disk. The locking surface incorporates a pair of parallel sharp edges wherein said edges are jammed against the cable, and/or deformed because the cable is made of harder material. In another aspect, the cable on insertion, dislodges a sacrificial U-shaped bracket to enable the cable to get past the disk. A relatively strong spring bears against the cable to enable firm backing, and the spring force is sufficiently strong that disk movement is assisted by the bracket to enable initial cable insertion.

19 Claims, 5 Drawing Sheets

CABLE LOCK AND SEAL DEVICE INCORPORATING SELF LOCKING FEATURE

This is a continuation in part application of previously filed U.S. patent application Ser. No. 08/362,843, now abandoned which was filed on Dec. 22, 1994.

BACKGROUND OF THE DISCLOSURE

The present apparatus is directed to a cable lock device which is used in sealing cargo containers. A cargo container is typically an enclosed shipping package, and can range from a container holding a few pounds of cargo up to a large trailer mounted container. At the larger end, the device can be installed on a rail car of enclosed construction having a closable door so that the rail car container is a secure, closed vehicle. The cable lock device is used to provide security in that tampering is prevented; this effectively discourages theft, pilferage or entry during shipping or storage.

Representative devices known heretofore are shown in U.S. Pat. Nos. 3,770,307 and also 4,747,631. These representative devices are cable lock mechanisms. The cable has relatively light gage. Because it is relatively light, it is not intended as a total bar to entry; rather, it is meant and does function successful as a bar to entry in which the cable lock device stops entry by discouraging tampering or pilferage. Indeed, to exclude entry, the device would require a large scale, heavy gage lock mechanism, one sufficiently large and strong to preclude cutting by bolt cutters, or other metal cutting devices. This is a device which is intended to be used in a disposable fashion. That is, cargo is loaded into a container such as a large rail car or a small vault which is delivered to a freight facility and shipped. The cargo can range from several tons to perhaps 10 pounds of important materials. The cargo can be solid or liquid. The cargo can be bulk materials or finished goods. Indeed, the cargo can have any size or shape.

The cable lock mechanism is threaded through the eyelets provided for the cargo container or housing and is fastened. Once fastened, it is intended that the cable lock device preclude entry by showing any tampering. A common mechanism is a variety of lock devices which clasp on or to a small woven cable. A representative cable is in the range of about 1/16 inch in diameter. As will be implied from that dimension, such a cable lock is a very good talisman indicating tampering. There have been cable lock devices provided heretofore which have been defeated. They can be defeated or overcome by working the cable lock device with the cable. Typically, the cable is looped through the locking device so that a bight is formed in the cable. The bight is looped through the cabinet or housing in which the cable lock device is installed. By patient reciprocation of the cable in the locking device, it can be worked so that the lock mechanism is upset, thereby permitting a gradual sliding movement of the cable. As an example, the device set forth in the '307 patent mentioned above is subject to defeat by this reciprocating motion. When steadily worked patiently, the cable will slide back and forth and move the rotating lock member 78 to a position where it creates a minimal wedging action, thereby loosening the grip of the point 79 which jams into the cable. This tends to work the cable free when done patiently. Substantially the same can be said with regard the '631 patent mentioned above. It also has a locking disk 27. That disk 27 cooperates with a pointed gear 38 which serves as a locking point to jam against the cable when inserted. Nevertheless, locking is defeated so that the teeth of the gear

38 jam against the cable and can be worked free with oscillatory motion applied to one end or the other of the cable bight. This is especially detrimental where the cargo container sits at a location which is out of view such as on a rail siding, in a warehouse, on a loading dock or at other untended locations. Pilferage can occur where the thief has adequate time to patiently work the cable back and forth thereby undoing the cable lock device. After pilferage the cable lock device is restored so that it appears newly installed and the time, date and place of the wrongful entry can no longer be identified. This is especially true where a device is shipped through three or four warehouses on a cross country trip. The pilferage may occur at any of the locations along the route. Protective remedies are difficult to implement in that instance. As noted above, one method of defeating this type of cable lock device is very patient reciprocating movement of just a fraction of an inch applied 50 or 100 times. That can be used to work the device free. In view of the risk of that problem, an enhanced set of features are included in the present structure.

The cable lock device of this disclosure incorporates a length wise groove adjacent to the installed cable wherein the groove is equipped with facing sharp edges which enable the two edges of the groove to pinch or bite into the cable. In that instance, the cable is jammed successfully to one side of the cable locus and is pinched by the facing sharp edges. Deformation of the cable and the edges occurs so that they become seated or nested. This in particular enables the cable to be held more firmly. In addition to that, the cable is spring loaded by a roller captured between a pair of tapering faces. The roller applies a pinching movement to the cable. In one embodiment, the cable is looped and installed in a duplicate device so that the cable is positioned next to facing, sloping walls and is captured by the movement of the locking disk. That is spring loaded and thereby urged into a closure contact to assure that the cable is locked in place. Two embodiments are set forth wherein both lock the free end of the cable in the same fashion. The cable is in both instances is provided with a fixed end. In one, the fixed end of the cable is captured as noted above where the particular embodiment utilizes a pair of facing surfaces which taper with respect to each other so that the tapering faces are able to clamp the cable, thereby securing the cable during installation. In the second embodiment, the cable is installed at the time of manufacture by crimping a sleeve on the cable, and locking the cable in place because the sleeve is sufficiently large that the cable dead end cannot pull free. In both embodiments, the cable is looped through the lock mechanism and emerges at a loop or bight, being slidably received in the locking device until the cable is pulled through the locking device. Once pulled into the device, locking occurs and is complete.

In both embodiments, the locking devices incorporates a housing having a cable locus therethrough extending between openings and defining a pathway through the housing immediately adjacent to a locking disk. When installed, the cable is contacted by the locking disk on one side of the cable and is jammed into the parallel facing sharp edges so that the cable is jammed and locked against the edges.

IN THE DRAWINGS

It has been discovered that one improvement which enables even greater resistance against working the cable free can be obtained in the following fashion. It is desirable to avoid this wiggling release problem attempted by a thief by increasing the strength of the spring in the cable lock housing, the spring bearing against the roller or disk which bears against the cable. If the spring is made unduly weak, defeat is obtained by patient working of the cable. If the spring is made stronger, that will not happen. But making the spring much stronger than that threshold requirement, the spring jams the disk without doubt or uncertainty in the tapered chamber for the disk. That assures that the cable is locked, but it is accomplished at a difficult price. One difficulty arising from that is the difficulty of initially threading the cable. As will be discussed, it is somewhat difficult to dislodge the disk when striking at the tangential edge where the cable is guided into the housing by the tapered faces defining the chamber which holds the disk or roller. The present disclosure overcomes this and enables a very strong spring to be used. Difficulties in loading the woven wire rope or cable are overcome by installing a sacrificial support in the form of a U-shaped bracket installed adjacent to the roller or disk so that the roller or disk is pushed away from a position preventing entry of the cable. Then, when the cable is inserted, it inserts substantially past a center line point on the roller or disk, slides past, and pushes the U-shaped bracket out of the way. The U-shaped bracket props the disk at a position remote from the point of entry to thereby enable easy entry. The cable then slides completely through the housing and extends on the far side.

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

DETAILED DESCRIPTION OF THE PREFERRED EMBODIMENTS

Figure 1:
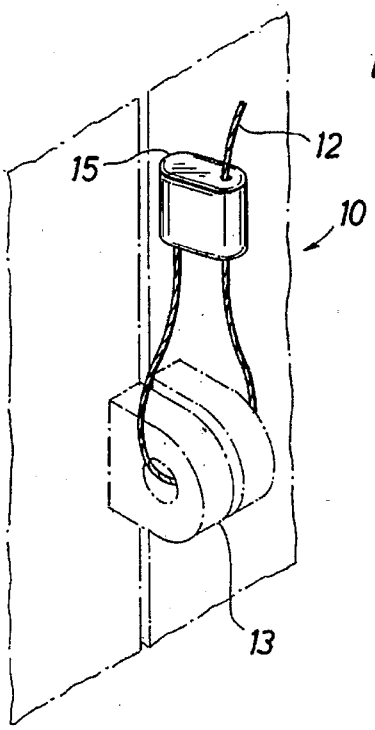
FIG. 1 shows a cable lock device in accordance with the present disclosure installed to close and seal a container.

Attention is now directed to FIG. 1 of the drawings in which the cable lock device of the present disclosure is identified with the numeral 10. In particular, it is formed with a looped cable 12 extending through a pair of tabs or eyelets 13 on a cargo container, housing, sealed suitcase, or smaller cargo containing box. It can be as large as a rail car. It will also include devices which store other valuable cargo. The cable lock device includes the cable 12 which is formed into a bight. The cable 12 passes through the housing 15 of the locking device. For a better understanding of the cable lock device 10, attention is now directed to FIG. 2, an enlarged sectional view, which shows the internal workings of the housing 15.

The cable housing 15 is preferably formed of metal having a specified hardness. It is a closed housing which has internal cavities as shown jointly considering FIGS. 2 and 3 together, and the cable 12 is routed through the housing in such a fashion that the internal cavities are closed by a cap 16 installed at one end of the housing 15. The housing 15 is formed with a cylindrical internal cavity 17 which terminates at a smaller passage 18. This enables the dead end 20 of the cable to be locked in its location. The dead end is locked by crimping a sleeve 19 on the cable dead end. The sleeve 19 is sized so that it fits on the interior of the chamber 17 but will not pass through the passage 18. A crimping tool is used to crush the sleeve 19 so that it is pinched on the dead end.

The cap 16 closes over the cavity 17. The cap 16 also closes over another cavity. This is better shown by viewing FIGS. 2 and 3 jointly. This shows a generally rectangular chamber 21 which is formed in the locking device 15. It is defined by a pair of parallel faces 22 and 23 along the major dimension of the device. The chamber 21 likewise extends between a pair of converging sidewalls 24 and 25. In the top portions of the structure, the sidewall 25 has a slope of perhaps 1 to 3 degrees. The top portion of the sidewall 24 slopes at some small angle, perhaps 2 to 5 degrees. The wall 24 slopes downwardly to the wall segment 26 which slopes inwardly at a larger angle. The wall 26 with respect to the wall 25 converges at an angle of about 14 degrees. With the wall 25 inclined at an angle of 1 to 3 degrees, this means that the chamber wall 26 slopes inwardly at an angle at about 11 to 13 degrees. The wall 26 is terminated at a transverse bottom wall 27. The wall 27 is parallel to the top plate 16. The interaction of the sloping walls will be detailed in discussing the operation of the locking disk which is cooperative with the sloping walls and the cable.

Figure 7:
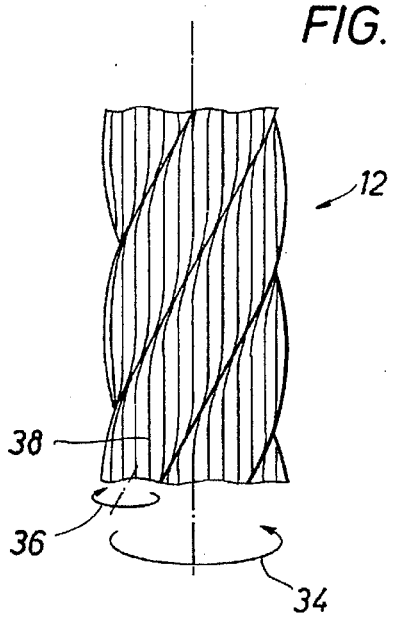
FIG. 7 is an enlarged view showing the woven steel cable formed of multiple strands.
Figure 3:
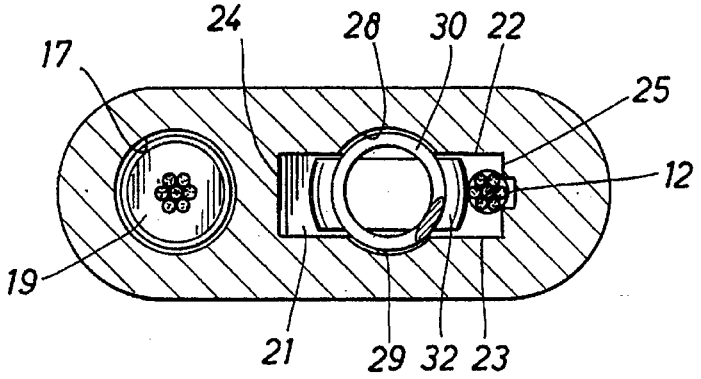
FIG. 3 is a sectional view taken along the line 3—3 in FIG. 2 of the drawings showing at the left the crimped end of the cable and at the right the position of the cable jammed against a pair of sharp edges for locking.
Figure 2:
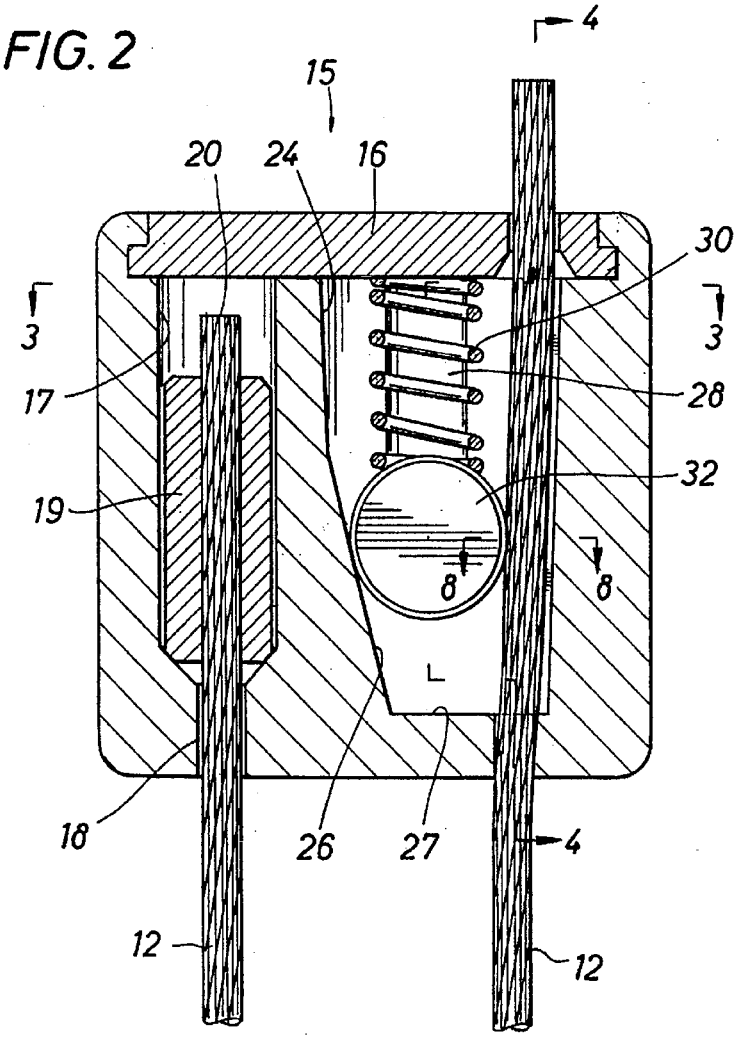
FIG. 2 is a sectional view through a first embodiment of the cable lock device of the present disclosure showing an installed cable having an anchored or dead end supported by a crimped sleeve and having a free end which is locked in the locking device by a spring loaded locking disk jamming the cable toward the side.

The chamber 21 is constructed with an enlargement comprising portions of a cylindrical overbore. To this end, FIG. 3 shows a circular segment 28 and a companion and facing circular segment 29 on the opposite inner wall. Two circular segments are formed by drilling an axial bore into the chamber 21. This provides clearance for a coil spring 30. The coil spring 30 is captured in the surrounding cylindrical bore, or more accurately partial hole, and is compressed under the cap or lid 16. The coil spring has several turns. The turns are compressed so that it forces a locking disk 32 downwardly. The disk 32 is sized so that it fits between the sidewalls 22 and 23 shown in FIG. 3 of the drawings. The locking disk has a diameter enabling the disk to move upwardly and downwardly in FIG. 2 of the drawings. This movement enable the disk to move against the sloping lower wall 26. The disk is able to move to the right in response to the sloping wall 26.

will be observed, the disk is provided with an outer periphery which is slightly crowned. This crown construction on the disk enables the disk to abut the cable 12. More will be given concerning the construction of the cable momentarily. The disk 32 is captured in this area so that the locking disk 32 is forced downwardly as shown in FIG. 2 of the drawings to clamp the cable 12. Going momentarily to the enlargements which are shown both in FIGS. 7 and 8, it will there be noted that the cable is preferably a woven cable. In this particular cable, which is relatively common and available from a number of sources, the cable is woven of seven strands in each of seven different subsets, thereby providing a cable which has 49 total strands. While this is not a requirement, it is a representative cable arrangement which enables the cable to provide the necessary strength as well as provide a cable which does not unthread. Unthreading of the cable is prevented in part by winding the cable so that there are both clockwise and counter clockwise winding in the cable. More specifically, and viewing the cable from the end, the cable in particular incorporates a twist applied to the cable as a whole and which is indicated by the arrow 34 in FIG. 7 of the drawings. Recalling however that the cable is formed of seven sets of seven strands, each of the sets is wound in the reverse direction as indicated by the arrow 36. This results in positioning individual strands which are approximately parallel to the central axis of the cable as represented by the strand 38 shown in FIG. 7. Restated, there are individual strands in the cable which at various locations are parallel and lengthwise with respect to the cable. Moreover, seven sets of strands are wound with a customary degree of tightness clockwise, and the cable is wound counter clockwise so that the cable strands tend to stay snug and tight, and the cable does not unravel so that the strands become frayed. Advantages are obtained in this cable construction.

Figure 8:
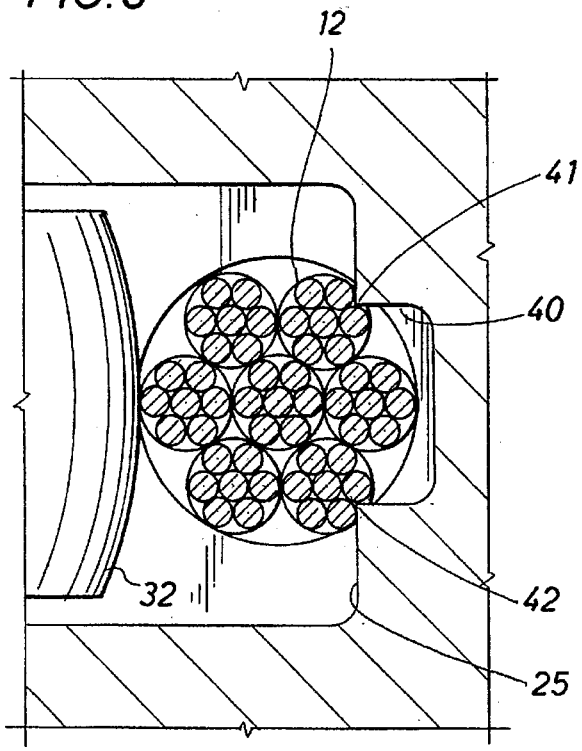
FIG. 8 is a sectional view along the line 8—8 in FIG. 2 of the drawing showing an enlarged view wherein the cable cooperates with the facing sharp edges of a groove adjacent to the cable to lock the cable to the housing.

One advantage of the well known cable construction is gained as shown in FIG. 8 of the drawings. There, one will observe that the cavity 21 is constructed with the sidewall 25 previously defined, and the sidewall 25 is interrupted by a groove 40. The groove is defined by a sharp edge 41 and a parallel matching sharp edge 42. The edges 41 and 42 are spaced from each other so that they define a gap or groove into which the cable 12 can be jammed by the locking disk 32. More specifically, this construction of the facing sharp edges enables the two sharp edges to serve as a pinching mechanism. It is preferable that the two edges be spaced at approximately 75–85% of cable width. While variations from this can be undertaken, it is preferable that the spacing be such that the sharp edges 41 and 42 are jammed into the cable so that the sharp edge indents the cable between strands. It will be observed that this cable deformation extends some length along the cable 12. This is intimated by the deflection of the cable which is shown in a representative fashion in FIG. 9 of the drawings. There, the cable is forced to the right, thereby forming a bent region 43. This bent region assures that the cable is jammed snuggly, firmly and vigorously against the sharp edges 41 and 42. This assures that the bite of the sharp edges 41 and 42 is sufficient to hold the cable to prevent rotation.

The cable is preferably made of steel wire having a specified hardness. This is one of the attributes of the cable and is a necessary factor to provide a cable of substantial strength. Indeed, through the use of 1/16 inch cable and in accordance with the present disclosure, the cable has sufficient strength that a pulling force in excess of 980 pounds is required to break the cable. While the specification may be different for different qualities of steel or different thickness of cable, it is safe to say that several hundred pounds are required to break the cable. In this particular instance, that dictates a particular hardness of metal in the cable. The housing 15 which surrounds the cable is formed of a softer material. It is preferable that the housing material not be equal to the cable in hardness of material. By the use of a softer metal such as some type of alloy of zinc, a softer material is thereby provided. In application, this results in deformation of the sharp edges 41 and 42. As a generalization, that is desirable because the deformation enables a better grip or clamping action to be obtained. Moreover, this gripping or clamping action enhances the length of the grip that is accomplished when the locking disk pushes the cable into the groove. Because the groove is deformed at the sharp edges 41 and 42, an improved grip is thereby obtained.

Returning again to FIG. 2 of the drawings, it will be understood that the position of the cable adjacent the locking disk is somewhat idealized. In fact, there is something of a bend or deflection forced in the cable as specifically shown in FIG. 9 of the drawings. This bend in the cable is significant to the grasp of the cable so that locking action is achieved.

Figure 4:
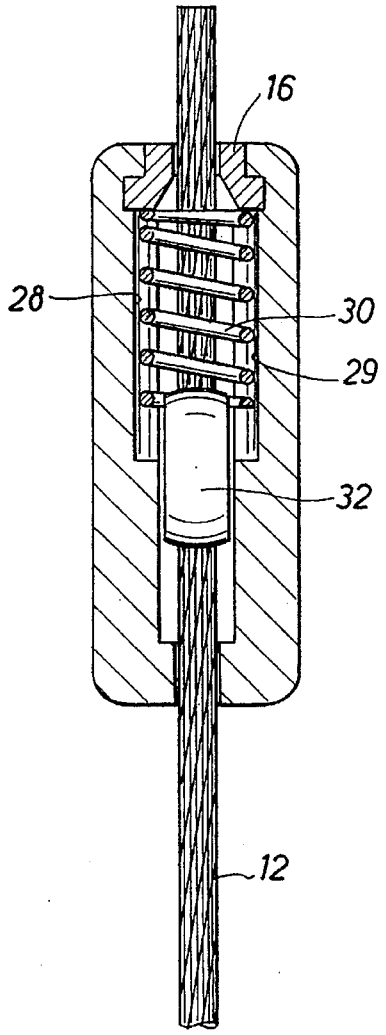
FIG. 4 is a sectional view taken along the line 4—4 in FIG. 2 of the drawings showing the cable jammed against the sharp edges when locked in position and also showing the locking disk beating against the cable.

Considering FIGS. 2, 3 and 4 jointly, it is important to note that the locking disk 32 is able to ride upwardly and downwardly until a wedging action is accomplished at the urging of the spring 30. The spring, being captured in the chamber below the cap 16, enables the free end of the cable to be locked or grasped.

In operation, the embodiment 10 is manufactured by placing the crimped sleeve 19 on the end of the cable 20. This forms the dead end of the cable. The cable is threaded through the smaller passage 18. This pulls the crimp sleeve 19 down into the chamber 17. Locking occurs at this juncture. That is, the dead end is held by this construction once the cap 16 is in position. The cap 16 is installed to capture the disk 32 and the spring 30 thereabove. Even should the locking disk fall to the bottom and be clear of contact with the spring 30, contact with the spring is ultimately accomplished. The spring 30 as shown in FIG. 2 of the drawings is captured so that it is always positioned above the locking disk. At that time, there is ample room for the locking disk so it is free wheeling in a sense because it is not clamped. That occurs so long as the free end of the cable 12 has not been inserted. At the necessary moment, the cable is threaded through the tabs or eyelets 13 (see FIG. 1) and the cable is then threaded through the housing from the bottom to the top referring to FIG. 2 of the drawings. The cable is snaked from bottom to top relying primarily on the stiffness of the cable. The cable is forced upwardly especially in the fashion shown in FIG. 3 of the drawings immediately adjacent to the groove having the sharp edges 41 and 42. As the cable slides upwardly, the cable is then positioned so that locking can occur. At this moment, the cable is then locked in position by its interaction with the locking disk. First, the cable is positioned very loosely adjacent to the sharp edges 41 and 42. Assuming that gravity or the cable spring action prevails, the locking disk will lightly touch the side of the cable. At that juncture, locking has not really been initiated.

Locking occurs by forcing the cable upwardly as shown in FIG. 2 of the drawings and then pulling firmly and snuggly downwardly on the cable. The cable is pulled downwardly thereby pulling the disk downwardly on the sloped area. When this occurs, the disk forms more bend in the cable, creating a larger deformation, deformation approaching that of FIG. 9 of the drawings, and forcing the cable against the sharp edges 41 and 42. The sharp edges grasp or hold the cable by deformation. The edges can be deformed readily, thereby enhancing the grip of the edges on the cable so that the cable cannot thereafter be pulled free. Should a person try to work the cable free after a bight has been taken whereby the sharp edges 41 and 42 are deformed, providing repetitive oscillatory motion to the cable will not otherwise work the cable free. When such motion occurs, the locking disk 32 may well oscillate upwardly and downwardly with the cable but the cable is jammed repetitively by the locking disk when the cable is pulled downwardly in FIG. 2 of the drawings. Every downward pull on the cable continues the locking action. A downward pull on the cable simply will not pull the cable free. It causes a tighter grip to be achieved time and again. In other words, working the cable to and fro will not release the cable 12 from the housing.

Figure 5:
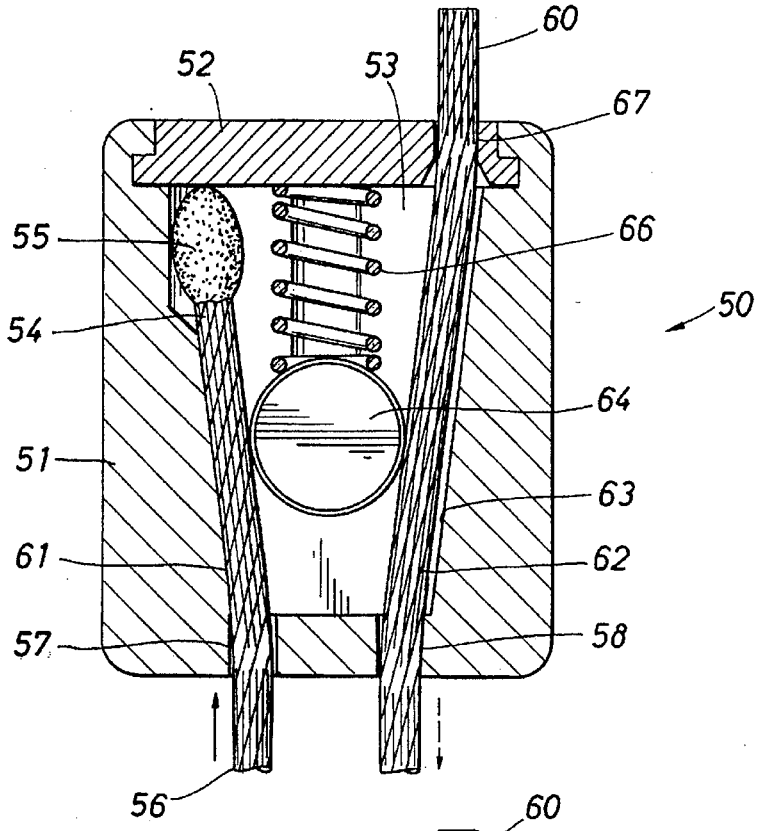
FIG. 5 is a section view similar to FIG. 2 showing an alternate embodiment wherein the dead end of the cable is provided with an enlargement and further showing how both ends of the cable bight are secured by the locking mechanism.
Figure 6:
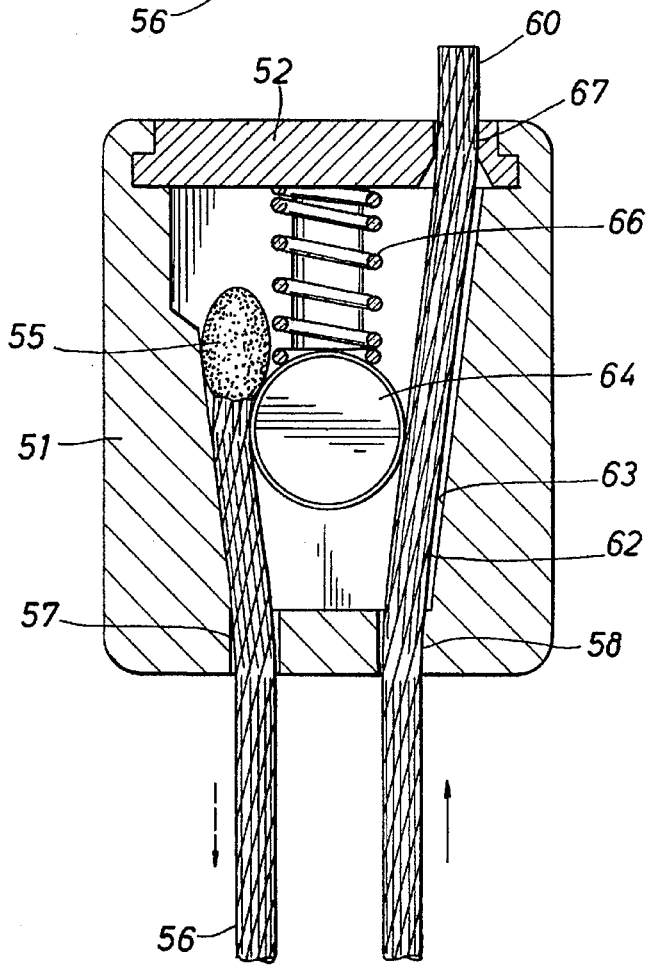
FIG. 6 is a view similar to FIG. 5 showing the movement of the locking disk in cooperation with the cable at the time of installation.

A different construction is shown in FIGS. 5 and 6 jointly which is equally effective. In this particular instance, the internal construction of the cable lock housing is somewhat different. To end, the reference numeral 50 identifies the alternate embodiment. This embodiment 50 is constructed so that it grasps the cable on both ends. More specifically, the embodiment shown in FIG. 5 of the drawings utilizes a similar housing 51 which is constructed with a cap 52 closing over an internal chamber 53. Again, a cable is incorporated and in this instance, the cable has a dead end 54 which is clamped by large bulbous mass 55 on the dead end of the cable. This mass can be crimped or welded on the cable. The numeral 56 identifies the bight of the cable which is obtained by looping the cable so that both ends of the cable will pass through the housing 51. While the numeral 54 identifies the dead end of the cable, the free end is identified at 60. The free end of the cable locked as explained in careful detailed given below.

The housing includes a passage 57 which enables the dead end of the cable to extend up into the housing. There is a second and similar passage 58 in the housing. The passage 58 in conjunction with the passage 57 is sized so that the cable can pass through both passages. The passage 57 is immediately adjacent to a tapered sidewall 61 in the chamber 53. In similar fashion, there is a tapered sidewall 62 facing the sidewall 61. The two taper together, thereby forming a pair of sidewalls which converge at a specified angle. The angle can be in the range of about 10 degree convergence. It can increase to about 20° but about 13° or 14° is considered optimum. The sidewall 61 is constructed as a planar surface. The sidewall incorporates a central groove 63 of the same construction shown in FIG. 8 of the drawings. That is, the groove width is less than the cable diameter, and is provided with facing sharp edges.

The chamber captures a locking disk 64 which operates in the same fashion as the locking disk 32. The locking disk 64 is likewise urged downwardly by a compressed coil spring 66. The spring is captured in a circular counter bore of the sort shown in FIG. 3 of the drawings. This assures that the spring stays in a fixed location. This assures that the spring bears against the locking disk 64 in the intended fashion.

In operation, the housing 50 functions in the following manner. The dead end 54 is captured in the illustrated position and the cap or lid 52 is installed. At the time of use, the free end 60 is threaded upwardly through the opening 58. It is forced upwardly and is moved along adjacent to or parallel to the sidewall 62. The free end emerges from the housing through the appropriately aligned upper opening 67. The free end is then pushed back through to the extent necessary to achieve locking. Attempted unlocking is done by pulling downwardly on the free end in accordance with the arrow shown in FIGS. 5 and 6 of the drawings. Alternating push and pull can be applied at both ends of the loop. This is shown in the contrast between FIGS. 5 and 6 where the bulb 55 is moved downwardly into contact with the locking disk 64. By pulling downwardly on the free end 60, locking is initiated whereby deformation occurs of the sharp edges abutting the cable. Locking is then assured so that the cable cooperates with the deformed sharp edges to lock the cable in place.

In terms of pilferage, any attempt to defeat the embodiment 50 typically involves working back and forth on both the dead end and free end of the cable. When such evasive maneuvers are applied, there can readily be some movement of the dead end because there is no groove on the left. Even so, the dead end is captured and will not escape. It can be wiggled and jiggled upwardly and downwardly, but that does not free the cable.

Cable oscillation at most simply moves the locking disk upwardly and downwardly. Wiggling and jiggling the other side to hopefully detach the free end 60 from the housing 50 does not succeed either. This holds the cable because it is deformed and jammed cooperatively with the sharp edges. Even in the instance where there might be some flattening of the cable as the strands become deformed from the intended original arrangement, that does not free the cable so that the cable can slip out of the housing 50. Rather, that simply enables the cable to take a better set vis-a-vis the soft metal housing around the cable. This locks better and better even as oscillatory motion is applied.

Referring to both embodiments, it is not possible to oscillate by pushing and pulling the two ends and thereby unlock the cables. In one aspect, the dead end of the cable is captured so that it can oscillate two or three times. There is no vertical clearance for continued oscillations on the dead end. The cable jams upwardly against the overhead cap which closes the housing. The dead end may go back and forth just a few times and repeated manipulation will not succeed in working the locking disk to a position whereby the free end of the cable is released.

The arrows shown in FIGS. 5 and 6 show how two or three strokes can be applied at most; the displacement of the dead end shows locking of that side. Once that side has been locked, it is no longer possible by downward pull on the free end to obtain slippage.

Figure 9:
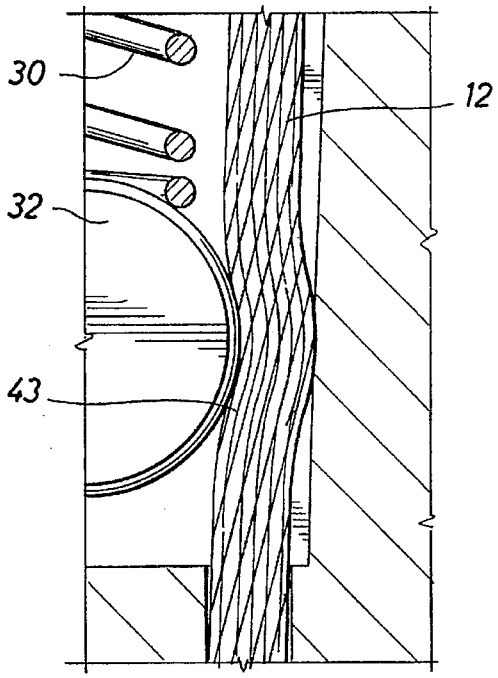
FIG. 9 is an orthogonal showing deformation of the cable during locking to better explain the locking mechanism illustrated in FIG. 8.

Locking in both embodiments occurs in the fashion illustrated in FIGS. 8 and 9. The cable is forced to the side. When the cable is forced to the side, the sharp edges 41 and 42 bite into the cable, thereby grasping the cable in an enhanced fashion. This kind of locking assures that the cable does not slip. In part, this is achieved with the accompanying deformation of the sharp edges 41 and 42. Preferably, the cable is made of a harder steel while the housing is made of a relatively softer alloy. The alloy is especially useful in controlling the relative degree of deformation. The width of the groove 40 is tailored to the cable width so that a grip is obtained on both sides. The grasp of the cable at the edges 41 and 42 is assured by motion of the locking disk 32 and 64 in both embodiments.

Figure 10:
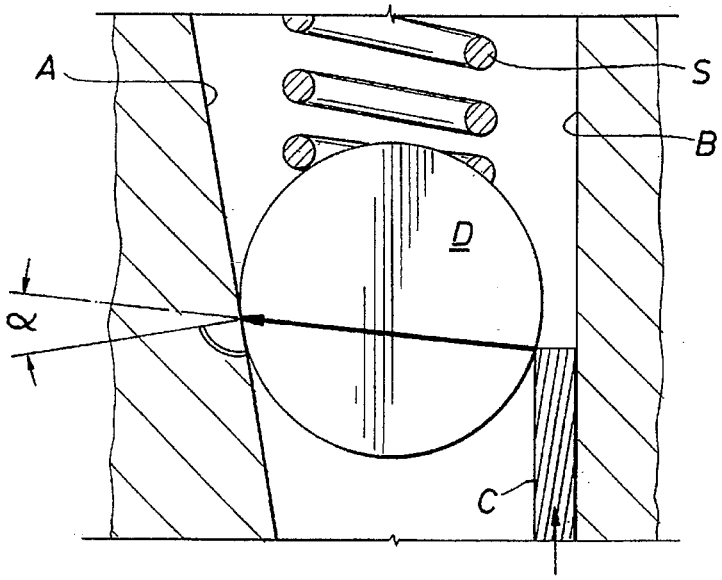
FIG. 10 is a view showing the interaction between the tip of the cable of the moment of insertion when the cable must move past the roller and illustrates a chord across the disk where locking may occur, thereby preventing cable entry.

Attention is now directed to FIG. 10 of the drawings which is included to set forth a particular problem which derives from certain aspects of the geometry involved in insertion of the cable. For tutorial purposes, assume that a roller or disk D is forced by a spring S against the tapered side walls A and B. Assume also that a cable C is forced into the housing. The cable C is intended to slide just past the disk D and to cause it to rotate slightly as it moves past the point of contact. There is a tendency dependent on the spring force, for the cable C to snag. So to speak, the disk cannot be dislodged simply by inserting the cable C. This happens in part as a result of the geometry represented by the chord line across the disk D which provides a point of contact with the tapered side wall A. When the disk D contacts the side wall A, the side wall and disk D define a normal bearing load. The chord as illustrated in FIG. 10 inscribes an angle $\alpha$. This angle can be made larger if the side walls A and B have a greater divergence. That however is difficult to obtain. As a generalization, the angle of the normal force indicated in FIG. 10 is less than about ten degrees. Consequently, the woven cable will not slide through or past the disk. This is especially true once a particular spring force is exceeded by the spring S.

A strong spring is desirable to assure better locking. A weak spring is desirable for ease of inserting the cable. These two requirements are contradictory in the design of the apparatus. These two requirements create a situation in which spring must at once be both weak and strong. That accommodation cannot be readily obtained in the ordinary circumstance. Therefore, the embodiment described in FIGS. 11–15 overcomes that problem.

EASY INSTALLATION OF THE CABLE

Figure 11:
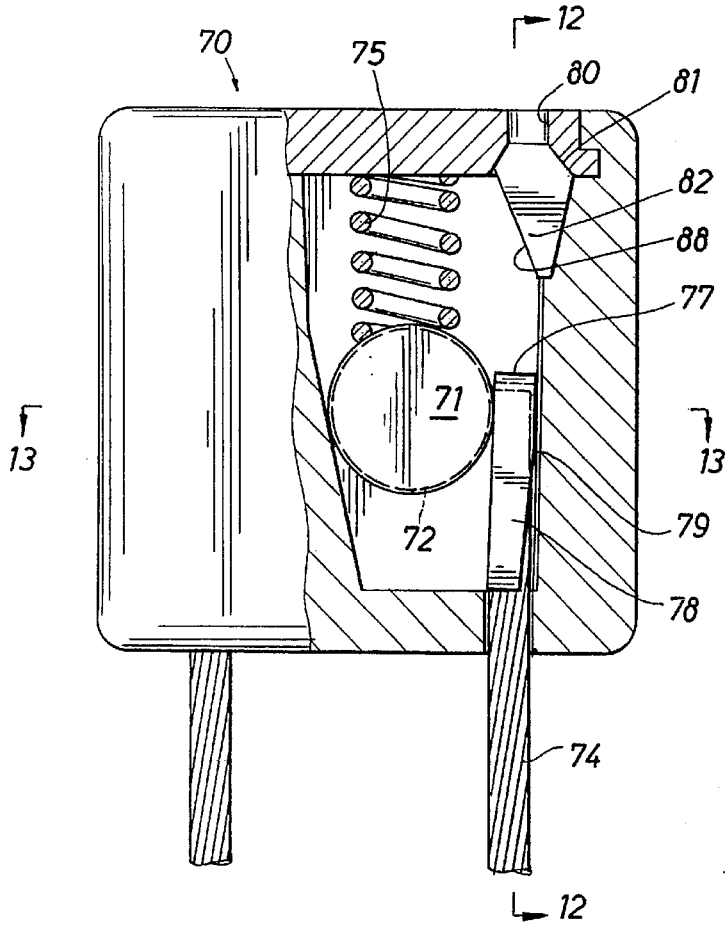
FIG. 11 shows an alternate embodiment in accordance of the teachings of this disclosure in which a U-shaped bracket is installed so that the bracket holds the disk away from the path of the cable during insertion.

Shifting topics and directing attention to FIG. 11 of the drawings, the embodiment 70 indicated in that view is substantially similar to the embodiment shown in FIG. 2 with the exceptions detailed below. The disk 71 is constructed with an encircling groove 72 which defines a pair of disk mounted sharp edges for biting the cable 74. Recall that the embodiment of FIG. 3 includes a pair of spaced sharp edges which bite the cable 12 in that view from one side, and FIG. 11 shows that the disk or roller 72 has been provided with the necessary groove 72 to enable biting the cable at four locations. Two sharp edges are brought to bear against the cable on one side and two sharp edges bear against the cable on the opposite side.

Figure 12:
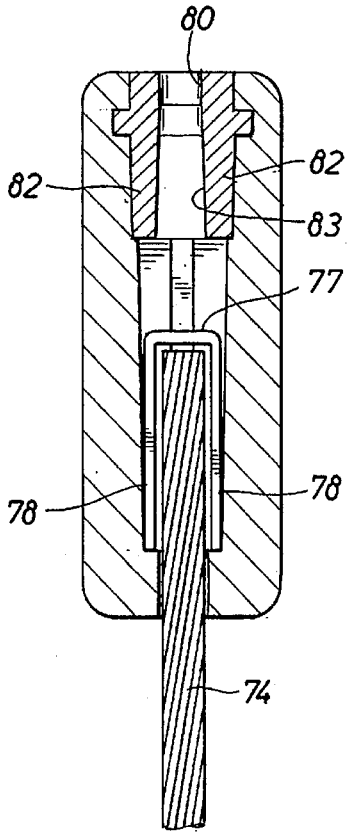
FIG. 12 is a sectional view along the line 12—12 in FIG. 11 showing the manner in which the cable is inserted, and also showing how the cable dislodges the U-shaped bracket after the cable has been inserted.

The spring 75 in FIG. 11 is much stronger by choice. It is so strong that it ordinarily would not permit the cable 74 to be inserted. There would be a strong tendency for the cable to simply lodge and stick in the deployment exemplified in FIG. 10 of the drawings. There is however an improvement in accordance with the teachings of the present disclosure having the form of a U-shaped bracket 77 which enables cable insertion. The bracket 77 is U-shaped and has a hollow throat of sufficient width to thereby enable the cable to fit within the bracket, note the width of the bracket 77 as shown in FIG. 12. The bracket has a transverse bottom which has a width equal to and preferably greater than the cable diameter. The bracket also has a pair of parallel legs 78. As shown jointly in FIGS. 11 and 12, the width of the bracket is such that it spans the chamber provided in the housing. It is constructed with a pair of parallel legs 78 as mentioned, and the legs 78 extend towards the bottom of the chamber. Each leg is tapered beginning at 79 and has a narrow bottom end. The taper beginning at 79 enables deflection of the bracket as will be described.

The bracket is installed without the cable. Therefore, it is made and shipped in the form shown in FIG. 11 absent the cable 74 pushed into the bracket. At the time of installation, the cable 74 is pushed up into the housing as shown in FIG. 11 and strikes the bracket. More importantly, the cable enters and passes so far along the side of the disk 71 that it moves completely beyond the disk without engaging the disk. The bracket 77 is thicker than the diameter of the cable.

This enables the cable to move freely and not snag or be blocked by the disk shown in FIG. 10 of the drawings. The cable moves freely, all the while passing adjacent to the disk 71 which is spaced away from the side wall by the bracket interposed in the locus of the cable.

The cable ultimately passes through the opening 80 at the top of the housing. The opening in this aspect is modified from that shown in FIG. 2. FIG. 2 shows how the cable is funneled up into the opening and directed out through the opening. In like fashion, there is a tapered surface 81 which funnels the cable tip towards the opening 80. On the lower side of the opening 80, there are a pair of tapered walls 82, the walls 82 serving as a slot defining surface so that the cable tip can be received in the opening 80 by passing through the funnel shaped area 83 there below as illustrated in FIG. 12.

Figure 14:
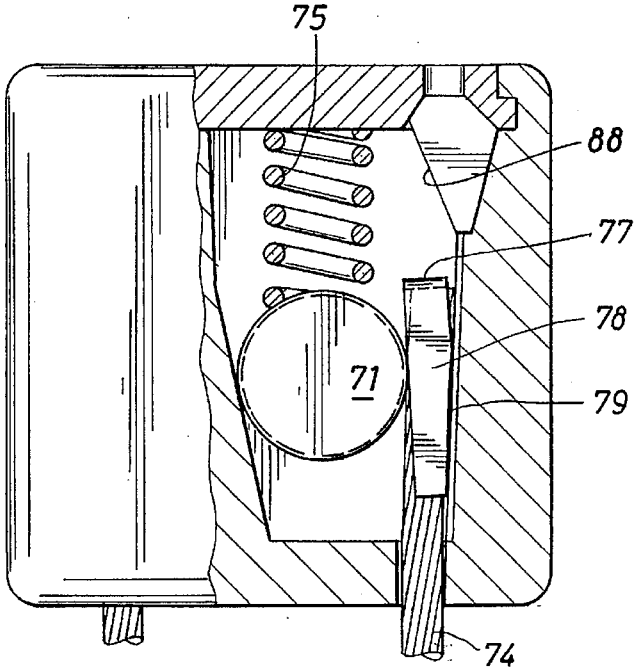
FIG. 14 is a view similar to FIG. 11 showing further entry of the cable into the housing so that the locking mechanism is initially set by dislodging the circular roller or disk.
Figure 15:
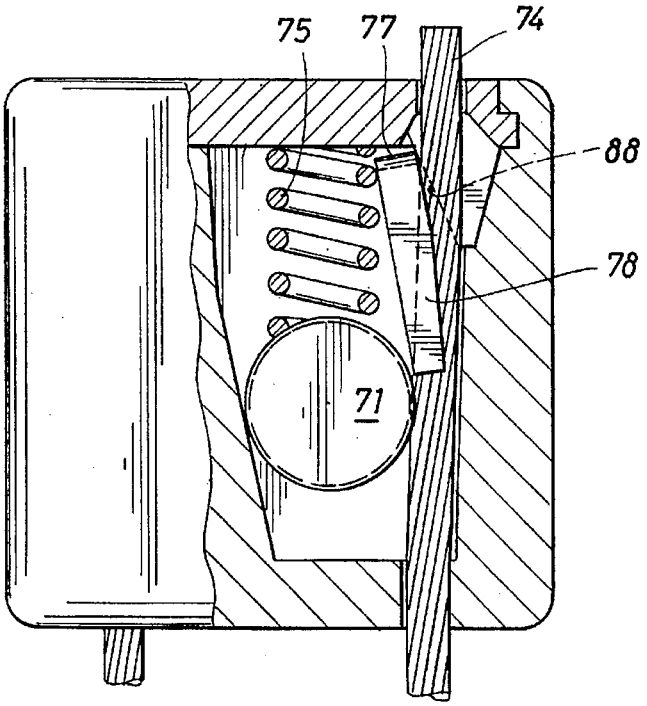
FIG. 15 shows emergence of the inserted cable from the housing of the locking mechanism and further showing how the U-shaped bracket is forced to the side.

This will become more readily apparent on consideration of FIGS. 14 and 15 jointly. Going now to FIG. 14, the bracket is shown with the cable moving upwardly. FIG. 14 shows the cable 74 after the cable has moved even further into the housing. This causes the disk or roller 71 to roll away from the cable 74. Cable thickness is less than the thickness of the bracket so that the bracket moves upwardly easily. Movement of the roller is occasion as the bracket cants slightly as it rests on the sloping surfaces 79. This wobble or canting of the bracket is preliminary to ejection of the bracket from between the disk 71 and contact with the adjacent housing.

FIG. 15 shows further extension of the cable. Here, the bracket is forced upwardly, moving with the tip of the cable until the tip of the cable is located in the funnel shaped region below the opening 80. The cable bends or deflects so that it is guided out through the opening 80. While that movement is accomplished, the bracket is forced upwardly and to the left. This enables the cable to be inserted while overcoming the resistance of a much stronger spring 75 than would ordinarily be permitted. Going into some detail, the cable is guided along the side of the housing and extends past the wheel as the tip end moves toward the opening. The cable diameter is smaller than the opening 80 and is guided into the opening by the funnel 81 therebelow so that cable insertion is assured for emerging from the clasping grip of the roller. The cable tip moves easily into the long slot next to the pair of sloping guide shoulders 88 along the cable pathway in the housing. The housing shoulders 88 kick over the bracket 77 which rides up on the shoulders 88 while the cable tip moves into the funnel and opening 80 to escape the housing.

When the cable tip arrives at the opening, the bracket 77 is out of the way and does not block or wedge the roller, thereby freeing the roller to clamp the cable. By the time this occurs, the cable has moved to the position shown in FIG. 15 of the drawings.

Figure 13:
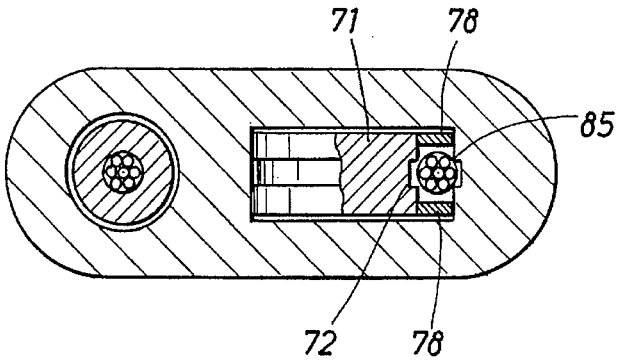
FIG. 13 is a sectional view along the line 13—13 in FIG. 11 showing details of construction of the U-shaped bracket cooperative with the tip of the cable when inserted.

Attention is momentarily directed to FIG. 13 of the drawings which shows the disk 71 with the groove 72 formed in the outer circular face. This defines a pair of sharp cutting edges which cooperate with similar cutting edges or shoulders 85 which define a parallel pair of edges along one side of the chamber of the housing (see also FIG. 2 of the drawings). As shown in FIG. 13, this then grasps the cable with four sharp edges, not just two. Two of the edges are formed on the roller and two of the edges are formed as a channel along the side wall of the housing.

Once locking is obtained as shown in FIG. 15 of the drawings, through the use of a stronger spring, and through the addition of four sharp cutting edges which lock against the cable, a better grip than ever before achieved is accomplished. As this better grip is accomplished, the chances of patiently working the cable back and forth to unthread the cable from the lock housing are markedly changed. The spring force assures quality locking of the cable to the housing. Patient working back and forth will no longer release this embodiment 70 because impart the spring force is sufficiently great to clamp the cable successfully and prevent this type of pilferage.

While the foregoing is directed to the preferred embodiment, the scope is determined by the claims which follow.

I claim:

1. A cable lock device for closing a cargo container comprising:

(a) a closed housing;

(b) an elongate cable having a free end and a dead end wherein the dead end of the cable is connected to said housing;

(c) an internal passage through said housing to receive said cable free end wherein the passage terminates at an inlet and outlet on said housing;

(d) a face in said housing along said passage adjacent to the free end of said cable when positioned therein;

(e) a jamming movable member within said housing adapted to move toward and away from said cable so that said jamming member is able to jam against said cable and thereby force said cable against said face; and (f) wherein said jamming member prior to jamming against said cable is moved away from jamming by a sacrificial spacer positioned within said internal passage and the cable end on insertion initiates jamming by the jamming member by engaging the spacer.

2. The apparatus of claim 1 wherein said housing includes a sized opening for receiving said cable dead end therethrough and incorporates an internal shoulder locking said dead end so that the dead end of said cable is enclosed within said housing and is not externally exposed.

3. The apparatus of claim 1 wherein said closed housing incorporates said face extending said internal passage and defines said passage, and further including a sharp edge adapted to contact against said cable.

4. The apparatus of claim 3 wherein said cable and said sharp edge are formed of materials having a different hardness so that one of said materials is yieldable to the other of said materials.

5. The apparatus of claim 3 including a second sharp edge parallel to said sharp edge and said edges are spaced apart by a distance less than the diameter of said cable and wherein said cable is formed of multiple strands and strands thereof dent said edges which are formed of a material softer than said cable.

6. The apparatus of claim 1 wherein said jamming member comprises a resiliently urged rotatable disk having a circular periphery bearing against said cable to urge said cable against said face.

7. The application of claim 1 wherein said spacer is an unattached, readily moved member positioned originally between said jamming member and said face, and is readily moved aside when said cable is inserted through said passage.

8. The apparatus of claim 7 wherein jamming member is a disk and said disk is confined between a pair of sloping faces to wedge therebetween, and one of said faces includes a sharp edge.

9. The apparatus of claim 8 wherein said disk is captured between said sloping faces to wedge therebetween and said cable, when installed in said housing, is positioned with the free end thereof positioned against one of said faces.

10. The apparatus of claim 8 wherein said sloping faces define, in cross section, a rectangular cavity for receiving said disk therein and said disk is loaded by a spring causing said disk to bear against said cable.

11. The apparatus of claim 10 wherein said disk is urged against said cable by a resilient coil spring captured in and confined by a surrounding cylindrical chamber.

12. The apparatus of claim 1 wherein said sacrificial spacer is a bracket between said movable member and said housing to separate said movable member by a distance equal to or greater than the diameter of said cable free end.

13. The apparatus of claim 12 including a sloping shoulder in said housing positioned to move aid bracket away from said cable and wherein said shoulder is constructed and arranged so that said cable end during insertion is guided by confining internal housing surfaces along said internal passage so that said cable is positioned between said inlet and outlet of said housing.

14. A method of locking a cable lock device on a cable so that a container may be sealed by the cable wherein the method comprises the steps of:

(a) connecting a dead end of the cable internally within a housing;

(b) forming a bight in the cable by looping the cable so that a free end of said cable is adapted to be extended through said housing;

(c) positioning a spacer bracket within the housing to move said jamming member by a distance greater than the width of said cable;

(d) pushing said free end of the cable into said housing;

(e) initially positioning a jamming member in said housing so that said cable free end may pass therethrough;

(f) jamming the cable so that cable deformation holds the cable against a sharp edge; and (g) holding the cable in the jammed position for locking the free end of the cable.

15. The method of claim 14 wherein the step of jamming the cable is done by forcing the jamming member against the cable.

16. The method of claim 15 wherein said bracket positions two parallel legs from each other and is sized to span said cable and be moved by said cable on contact with said cable.

17. The method of claim 16 wherein the cable is gripped by resiliently urging the jamming member against said cable.

18. The method of claim 14 wherein said housing is constructed with a pair of sloping, internal faces which converge at a specified angle and including the step of positioning said cable adjacent to one of said sloping surfaces so that said cable is gripped.

19. The method of claim 14 including the step of jamming the dead end of the cable into a locked position with respect to the housing to prevent escape of the cable dead end, and wherein the free end of the cable inserts into a pair of aligned openings in said housing for positioning said cable when installed, and said cable is immediately adjacent to first and second parallel sharp edges within said housing and said cable is jammed against said sharp edges.

* * * * *